United States Patent [19]

Wrin

[11] 4,026,252

[45] May 31, 1977

[54] ENGINE CONSTRUCTION

[76] Inventor: John W. Wrin, 1615 East Ave., Q-11, Palmdale, Calif. 93550

[22] Filed: Aug. 8, 1975

[21] Appl. No.: 602,925

[52] U.S. Cl. ..... 123/56 BC; 123/55 A; 123/56 B; 123/197 R; 123/197 AC

[51] Int. Cl.² ..... F02B 75/24

[58] Field of Search ..... 123/56 R, 56 B, 56 BC, 123/197 R, 197 AC, 55 R, 55 A; 74/44, 52, 15.63

[56] References Cited

UNITED STATES PATENTS

| | | | |
|---|---|---|---|
| 2,199,625 | 5/1940 | Fernbrugg | 74/52 |
| 2,223,100 | 11/1940 | Foster | 123/56 BC |
| 2,309,047 | 1/1943 | Culbertson | 74/52 |
| 2,757,547 | 8/1956 | Julin | 123/197 AC |
| 3,290,950 | 12/1966 | Carlson | 123/56 BC |
| 3,791,227 | 2/1974 | Cherry | 74/52 |
| 3,886,805 | 6/1975 | Koderman | 123/197 AC |
| 3,913,408 | 10/1975 | Moore | 74/52 |

*Primary Examiner*—C. J. Husar
*Assistant Examiner*—David D. Reynolds
*Attorney, Agent, or Firm*—Robert E. Geauque

[57] ABSTRACT

A two-cycle engine wherein a pair of pistons are mounted within a pair of cylinders which are arranged in an oppositely facing in-line manner with the connecting rods of both pistons being also in-line and rotatably mounted upon a crank shaft, the crank shaft extending through and rotatably mounted in respect to a planetary gear carrier. The planetary gear carrier is rotatably mounted within the housing to which the cylinders are fixed, the crank shaft being eccentrically mounted within said planetary gear carrier, said planetary gear carrier having an external ring gear mounted on the periphery thereof, said external ring gear to connect with an output gear assembly, said crank shaft having mounted thereon an internal gear, said internal gear located exteriorly of said planetary crank carrier, said internal gear being operatively connected to a ring gear which is fixed to the housing, the size of the internal gear being one-half the diameter of the internal ring gear, said crank shaft extending exteriorly of said housing and including counterweight means mounted thereon, said planetary crank carrier including counterweight means. A universal joint interconnects the connecting rod and the piston. A novel intake port arrangement is employed to inject fuel air mixture into each cylinder.

11 Claims, 9 Drawing Figures

ENGINE CONSTRUCTION

BACKGROUND OF THE INVENTION

The field of thie invention relates to improvements in internal combustion engines having reciprocating pistons and more particularly to a two-cycle type of engine wherein the fuel air mixture is fired within the cylinder each time the piston moves to the top dead center position.

Within the conventional type of reciprocating piston internal combustion engine, the piston connecting rods assume a canted or angular position during piston movement. This canting of the piston connecting rod causes side forces to be transmitted between the piston and the cylinder which increase wear therebetween. Also, undesirable vibrational forces are created due to the canting of the piston connecting rods.

Also, in the past it has been difficult to perfectly dynamically balance the conventional type of internal combustion engine. The reason for this is that the mass of the piston and connecting rod is a combination of reciprocating and rotating mass and cannot be perfectly balanced with rotating counterweights.

Further, more conventional internal combustion engines take power from the engine only on one side of the engine. This inherently produces undesirable wear of the engine bearings and gears by the unloaded side of the engine trying to "get ahead" of the loaded side.

SUMMARY OF THE INVENTION

This invention is believed to be summarily described within the Abstract Of The Disclosure and reference is to be had thereto.

The primary objective of this invention is to provide as perfect as possible of a mechanical balance of the moving parts of the engine of this invention. This balancing arrangement results in the engine of this invention operating with a very small amount of vibration and has an extremely high revolutions per minute potential. The low vibration results in the engine operating extremely smoothly and the high revolutions per minute potential results in a very high power output.

The peak combustion pressure of this invention will be at a lower value than conventional engines thereby decreasing stresses within the engine and causing the engine to operate with less vibration.

Within conventional engines, the major cause of engine damage is due to forces operating in directions other than toward the center of the engine. Within the engine of this invention, all major mechanical stresses act toward the center of the engine thus eliminating the main cause of engine damage.

The engine of this invention has significantly less internal friction which will result in a higher power output.

A significant advantage of the engine of this invention is that the engine can be constructed in a more compact manner than conventional engines and has less weight per horsepower produced.

In this invention, although the opposed pistons and their common connecting rods are apparently reciprocating and the rest of the movement is rotating, when viewed in reference to the entire movement it becomes evident that the pistons and connecting rods are also in constrained rotation along with the rest of the movement. Therefore, the pistons and rods can be treated as rotating mass and can be precisely balanced by rotating counterweights to achieve a perfect mechanical balance of the overall movement.

BRIEF DESCRIPTION OF THE SHOWN EMBODIMENT

Figure 1:
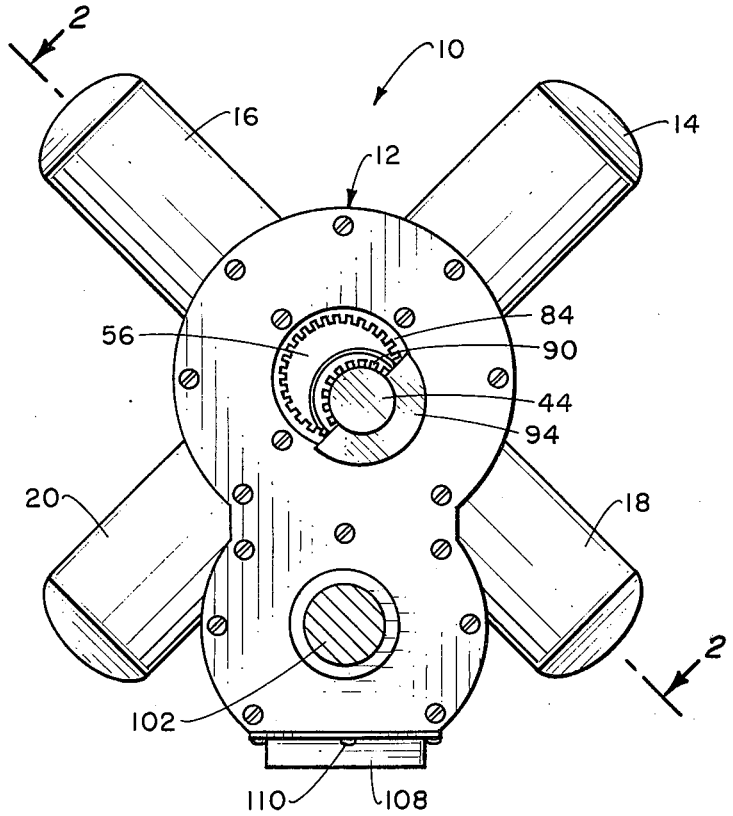
FIG. 1 is an exterior side view of the engine of this invention.
Figure 4:
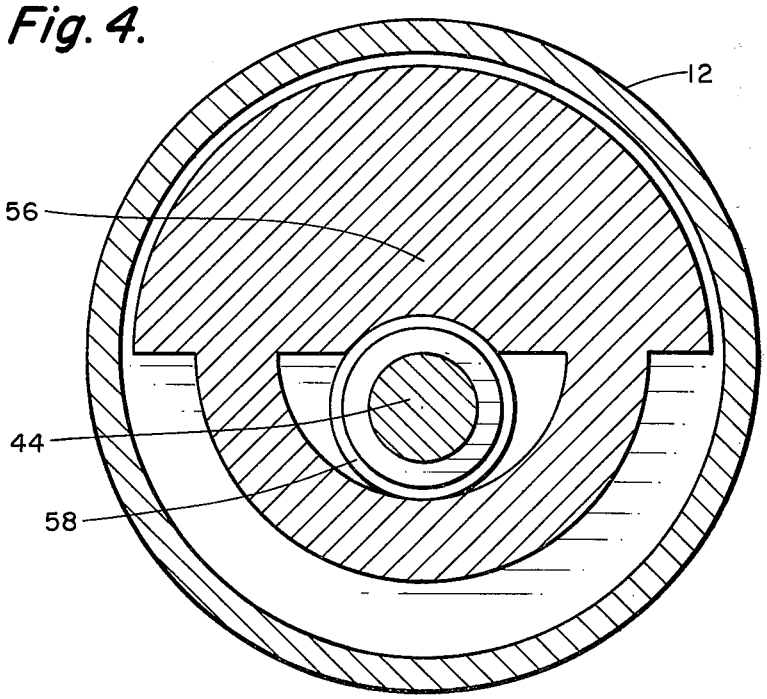
FIG. 4 is a cross-section view taken along line 4—4 of FIG. 2.
Figure 2:
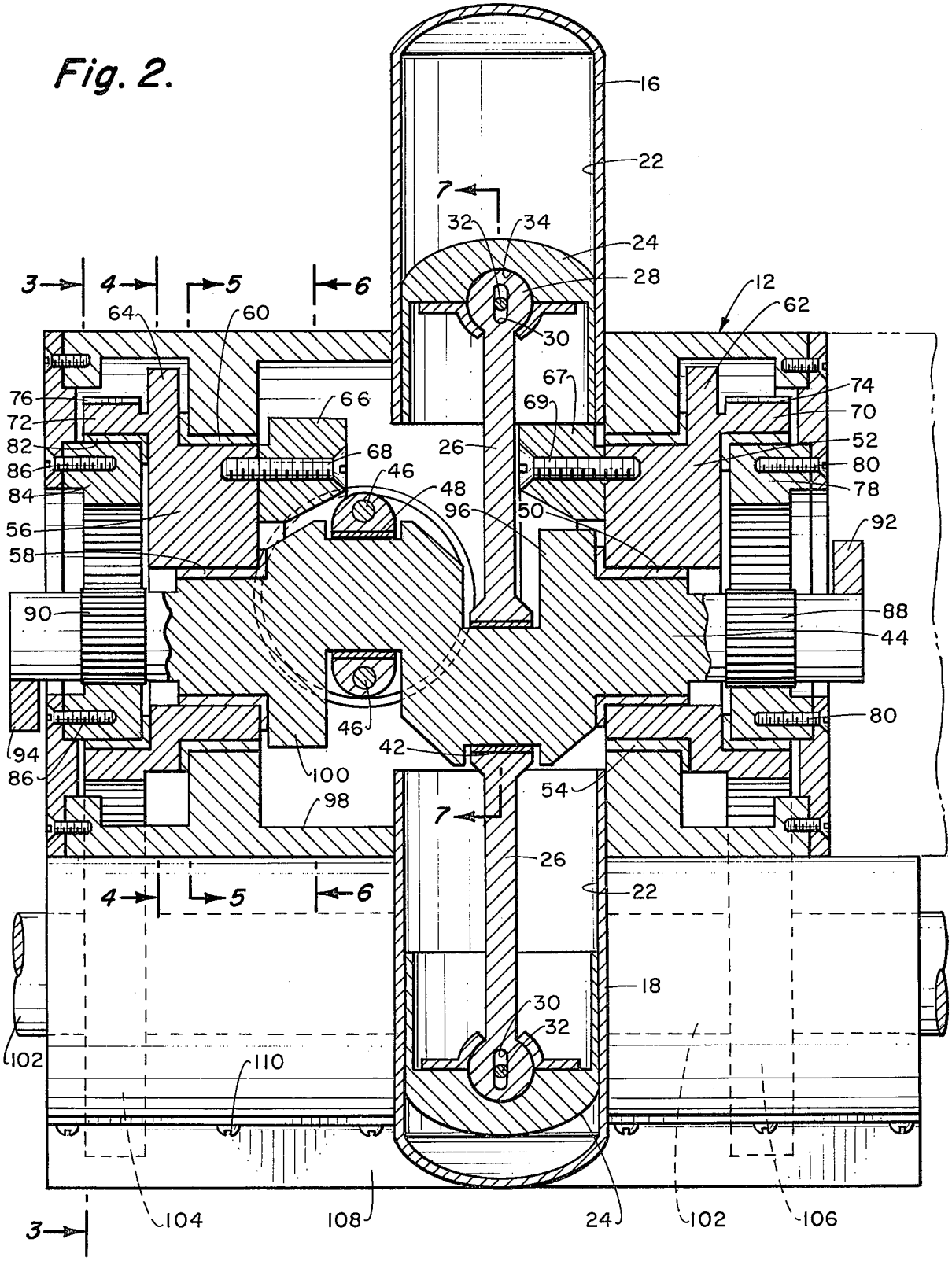
FIG. 2 is a cross-sectional view through the engine of this invention taken along line 2—2 of FIG. 1.
Figure 3:
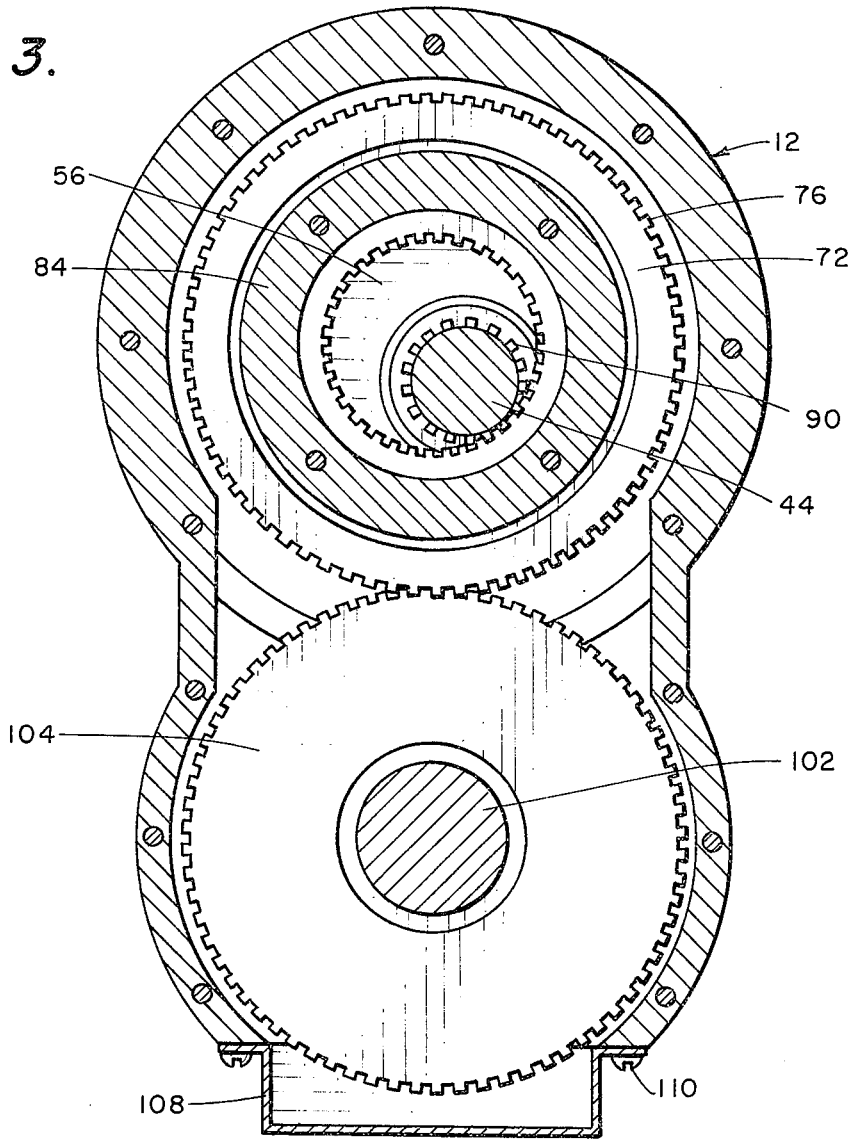
FIG. 3 is a cross-sectional view taken along line 3—3 of FIG. 2.
Figure 5:
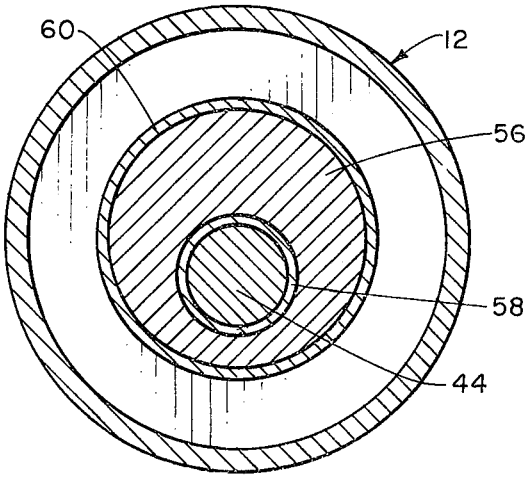
FIG. 5 is a cross-sectional view taken along line 5—5 of FIG. 2.
Figure 6:
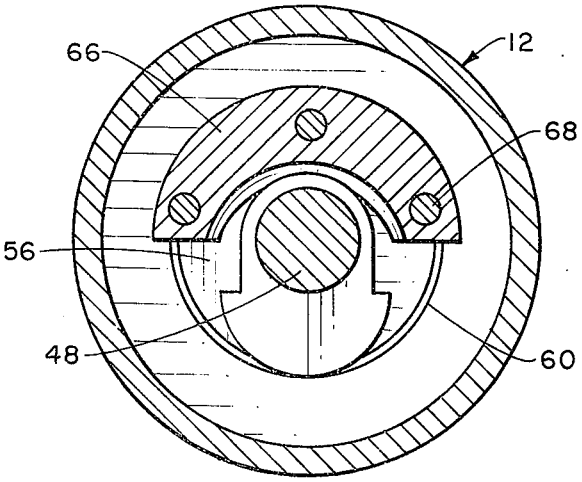
FIG. 6 is a cross-sectional view taken along line 6—6 of FIG. 2.
Figure 7:
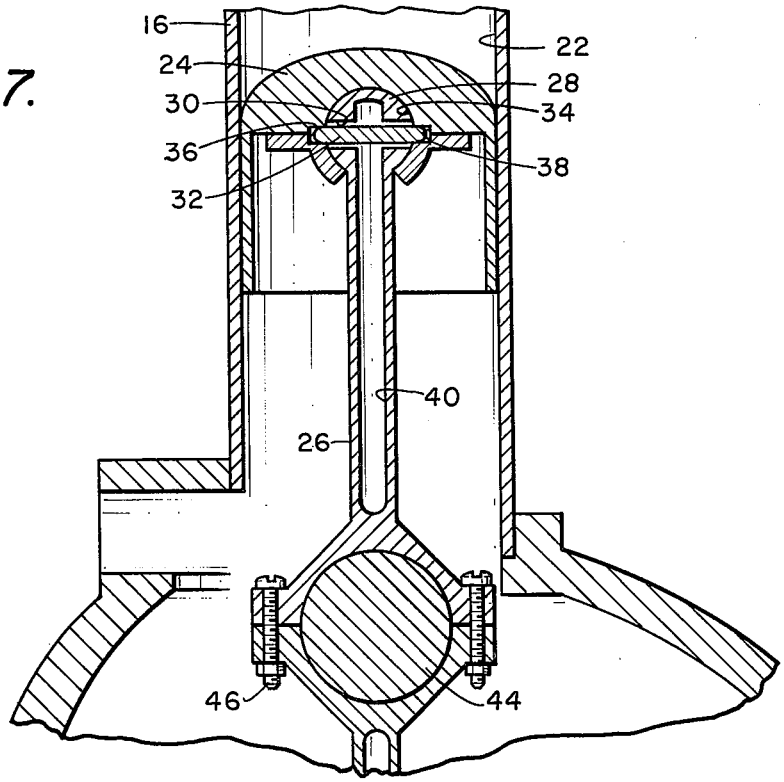
FIG. 7 is a cross-sectional view taken along line 7—7 of FIG. 2.

Referring particularly to the drawings, there is shown in FIG. 1, an overall view of the engine 10 of this invention. The engine 10 of this invention is designed primarily to be incorporated into a two-cycle type of engine. However, it is considered to be within the scope of this invention that the inventive concepts could be employed in other than a two-cycle engine, such as a four-cycle engine.

The engine 10 of this invention includes a housing 12 to which are secured a plurality of cylinders 14, 16, 18 and 20. Within each of the cylinders 14, 16, 18 and 20 is located a chamber 22. Within each of the chambers 22 is movably supported a piston 24. It is to be noted that the cylinders 16 and 18 are in alignment with one another but oppositely facing. In a similar manner, the cylinders 14 and 20 are in alignment and oppositely facing. The cylinders 14 and 20 are angularly displaced ninety degrees from the cylinders 16 and 18. Also, the cylinders 14 and 20 are laterally displaced from the cylinders 16 and 18, the reason for which will become apparent further on in the specification.

One end of each of the connecting rods 26 is formed into the shape of a ball 28. Extending through the ball 28 at approximately the center thereof is a slot 30. It is to be noted that the width of the slot 30 is substantially less than the height of the slot 30. A pin 32 extends through the slot 30 and extends exteriorly of the slot 30 on each side thereof. The diameter of the pin 32 is just slightly less than the width of the slot 30 so that lateral movement between the piston 24 and the connecting rod 26 is prevented. However, because of the enlarged nature of the slot 30 in the direction of the height, the piston 24 is capable of a certain amount of movement with respect to the pin 32 in the longitudinal direction. The reason for this is that if there is any slight misalignment of the piston 24 with respect to the connecting rod 26, at installation or during operation of the engine, this misalignment will be compensated for due to the pin 32 being positioned within the enlarged slot 30. The lateral movement between the piston 24 and the connecting rod 26 is undesirable. Because the ball 28 rests within a socket 34 formed within the piston 24, a secure attachment is provided between the piston 24 and the connecting rod 26. However, the connecting rod 26 is capable of a slight adjusting movement as previously mentioned. The ends of the pin 32 are securely mounted within openings 36 and 38 formed within the piston 24. The connecting rod 26 may be formed to include a hollow chamber 40 for purposes of lightening.

The inner end of each connecting rod 26 is bifurcated in a conventional manner so as to facilitate attachment to the crankpin 42 of the crankshaft 44 In actual practice with the engine of this invention the pair of aligned connecting rods 26 are bolted together by bolts 46 with the crankpin 42 located within the opening which is formed by the cooperating bifurcated ends of the connecting rods 26. It is to be understood that the crankpin 42 is rotatable with respect to the connecting rods 26. As will become apparent further on in the specification, during operation of the engine the connecting rods 26 will only move in a straight line as the connecting rods reciprocate.

Longitudinally spaced from the crankpin 42 is a second crankpin 48. The second crankpin 48. is used to rotatably support the second pair of connecting rods 26 which, in turn, are attached to the pistons 24 which are mounted within the cylinders 14 and 20. The construction of the pistons and their connections to their respective connecting rods 26 is identical to the foregoing description of the pistons 24 and their connecting rods 26.

Rotatably mounted to the crankshaft 44 by means of a bearing 50 is a planetary crank carrier 52. This planetary crank carrier 52 is positioned adjacent the crankpin 42. The periphery of the planetary crank carrier 52 is rotatably supported by means of a bearing 54 to the housing 12. It is to be noted that the crankshaft 44 is eccentrically disposed within the planetary crank carrier 52. In actual practice, it has been found to be preferable that the periphery of the shaft 44 passes through the rotating center of the planetary crank carrier 52.

A similar planetary crank carrier 56 is rotatably mounted by a bearing 58 upon the crankshaft 44 adjacent the crankpin 48. The planetary crank carrier 56 is rotatably mounted by means of a bearing 60 with respect to the housing 12. The location of the shaft 44 with respect to the planetary crank carrier 56 is similar to what was previously described in relation to the planetary crank carrier 52. It is to be noted that the planetary crank carriers 52 and 56 are facing each other and are, in essence, a mirror image with respect to the longitudinal center of the crankshaft 44.

Each of the planetary crank carriers 52 and 56 will normally include some counterweight structure, such as counterweights 62 and 64, and separately attached enlarged counterweights 66 and 67. The counterweight 62 is integrally mounted to the planetary crank carrier 52 with the counterweight 64, in similar manner, being integrally mounted to the planetary crank carrier 56. The counterweight 66 is attached by means of bolts 68 to the inner surface of the planetary crank carrier 56. In a similar manner, counterweight 67 is attached by means of bolts 69 to the inner surface of planetary crank carrier 52. It is to be noted that the shape of the counterweights 66 and 67 is basically one-half of a ring. This shape is so that the weight is naturally evenly distributed so as to provide for a more correct balance. This concept of the shape of the counterweights will be followed throughout this invention.

Integrally attached to the crank carrier 52 is an annular extension 70. A similar annular extension 72 is integrally formed upon the planetary crank carrier 56.

Formed upon the exterior of the extension 70 is an external ring gear 74. In a similar manner, formed upon the exterior of the annular extension 72 is an external ring gear 76. The function of the ring gears 74 and 76 will be explained further on in the specification.

The annular extension 70 is rotatably supported upon an internal ring gear 78. The ring gear 78 is fixedly secured by bolts 80 to the housing 12. In a similar manner, the annular extension 72 is rotatably supported by a bearing 82 to an internal ring gear 84. The internal ring gear 84 is fixedly secured to the housing 12 by means of bolts 86.

Mounted upon one end of the crankshaft 4 is a planet gear 88. The planet gear 88 is of a diameter one-half of that of the internal ring gear 78. The planet gear 88 is in continuous engagement with the internal ring gear 78.

At the other end of the crankshaft 44 is fixedly mounted thereon a second planet gear 90. This planet gear 90 has a diameter one-half of that of the internal ring gear 84. It is to be noted that the internal ring gears 84 and 78 of the same diameter as is also the planet gears 88 and 90.

Fixedly mounted on the free end of the shaft 44 adjacent the ring gear 78 is a counterweight 92. In a similar manner, a counterweight 94 is attached to the opposite end of the crankshaft 44 adjacent the ring gear 84. The function of the counterweights 94 and 92 are to dynamically balance the crankshaft of the engine of this invention after the pistons and rods have been installed. Again, these counterweights 92 and 94 are formed in the shape of one-half of a ring. It is also to be noted that the crankpin 42 is partially balanced by means of a counterweight 96 which is located within the interior chamber 98 of the engine which functions as an oil receiving chamber. In a similar manner, the crankpin 48 is partially counterbalanced by means of a counterweight 100 similarly located within the chamber 98.

As a result of the placing of the counterweights 92, 62, 64, 66, 67, 100, 96 and 94, the entire engine of this invention is almost perfectly balanced. By employing of the counterweights 92 and 94 longitudinally spaced from the center of the engine, a smaller counterweight can be employed which will achieve the same balancing effect as if a larger counterweight was employed within the interior of the engine. However, it is almost impossible to employ a sufficiently large enough counterweight within the interior engine in order to achieve a perfect engine balance.

Located within the housing 12 and mounted so that the longitudinal axis is parallel to the crankshaft 44 is an output shaft 102. Fixedly mounted on the output shaft 102 are output gears 104 and 106. Gear 104 meshes with the external ring gear 76 with gear 106 meshing with external ring gear 74. The ratio between gears 104 and 74 need not be a one to one ratio but must be the same. Also, instead of gear connections, a chain and sprocket connection could be used. The output shaft 102 is to be connected to appropriate load exteriorly of the engine 10 to which the rotational work produced by the engine 10 of this invention is to be supplied. It is to be noted that the work output from the engine 10 is supplied to the shaft 102 through an output gear assembly which is constructed so that there is one output gear on either side of the engine so that the output torque is taken from the engine in a balanced manner. In other words, the crankshaft would not tend to skew within the engine causing excess bearing and gear wear.

The output shaft 102 is located within a lower portion of the housing 12 which is closed by a cover 108. The cover 108 is attached to the housing 12 by means of bolts 110.

The operation of the engine 10 of this invention is believed to be self-evident in that a fuel-air mixture is combusted within each of the cylinders 14, 16, 18 and 20 in a sequential manner when the piston 24 for each respective said cylinder reaches approximately top dead center position. The work energy produced from the combusted fuel-air mixture is transmitted through its respective connecting rods 26 to the crankshaft 44 which causes rotation of the crankshaft 44. The rotation motion of the crankshaft 44 causes the crankshaft 44 to not only rotate, but to move in a circular motion about the ring gears 78 and 84. This circular motion causes the planetary crank carriers 52 and 56 to rotate about their axes and as a result causes rotation of the external ring gears 74 and 76. The rotation movement of the external ring gears 74 and 76 produces rotational movement of the output gears 104 and 106 and the output shaft 102.

It is to be noted that at no time does the connecting rods 26 ever assume a canted position with respect to its respective cylinder or piston 24. At all times during operation of the engine, the connecting rods 26 for the in-lined cylinders 16 and 18 remain in an in-line position and are actually integrally connected together by bolts about the crankpin 42. Ths same holds true for the connecting rods 26 of the cylinders 14 and 20. As previously mentioned, this type of engine construction not only minimizes but substantially eliminates any side forces exerted through the piston 24 to its respective cylinder wall.

Figure 8:
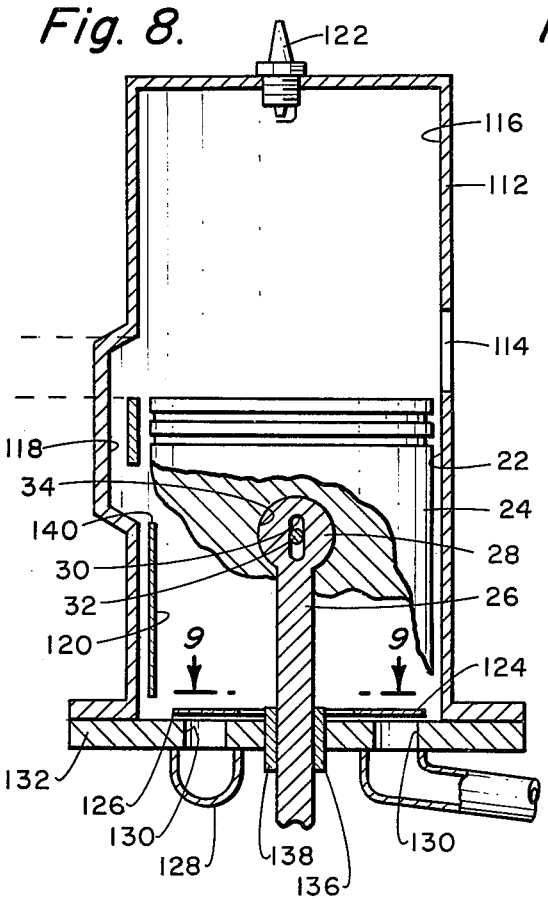
FIG. 8 is a diagramatic view of a type of porting arrangement which can be employed in conjuction with the engine of this invention.
Figure 9:
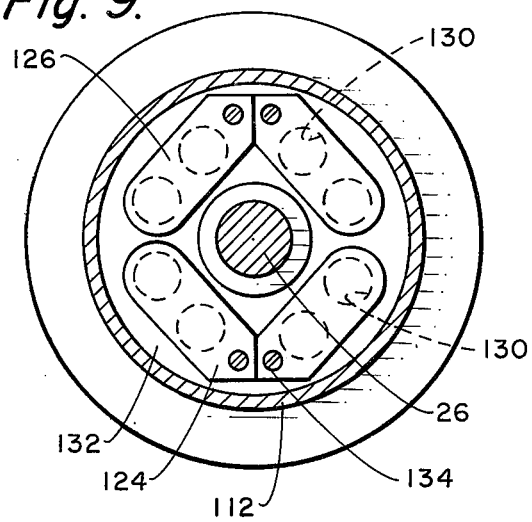
FIG. 9 is a view of the valve arrangement employed within the porting arrangement of FIG. 8 taken along line 9—9 of FIG. 8.

Another feature of this invention is that by having the in-lined connecting rods 26 move in a straight line, a fuel injection means for each cylinder could be employed, such as is shown in FIG. 8 of the drawings. Like numerals have been employed within FIG. 8 to refer to like parts. As the piston 24 reciprocates within the cylinder 112 of FIG. 8, at its lowermost position an exhaust port 114 is exposed which dissipates the exhaust gases from within the combustion chamber 116. This occurs when the piston is in the area of the bottom dead center position.

Also located within the wall of the cylinder 112, diametrically opposite the exhaust port 114, is an inlet port 118. Fuel air mixture is to be located within the interior chamber 120 of the piston 24. As the exhaust gases leave the chamber 116 through the exhaust port 114, a fuel air mixture is being conducted through the inlet port 118 to within the combustion chamber 116. As the piston moves toward the top dead center position, the exhaust port 114 is closed as well as the inlet port 118 and the fuel air mixture is compressed with such being ignited by means of spark plug 122 when the piston 24 is in the top dead center position. As the piston 24 moves upwardly, a suction is created within the chamber 120 which causes the reed valves 124, 126 to be unseated. When the reed valves 124 and 126 are unseated, the fuel air mixture which is located within manifold 128, (which is connected to the carburetor) is permitted to be conducted through the openings 130 (eight in number being shown) which are located within the plate 132. The manifold 128 is attached to the underneath side of the plate 132 with the reed valves 124 and 126 being attached to the upper side of the plate 132 by means of bolts 134. When the piston reaches top dead center positions, the reed valves, which are normally biased to the closed position, do move to the closed position thereby preventing communication from the manifold 128 through the openings 132 to the interior chamber 120. The piston connecting rod 26 is slidably mounted with respect to the plate 132 through an opening 136 formed within the plate 132. A bearing 138 mounts the connecting rod 26 with respect to the plate 132.

When the piston is in the top dead center position and the piston starts to begin to move to the bottom dead center position, the fuel air mixture contained within the interior chamber 120 becomes compressed. When the piston 24 is close to the bottom dead center position, the compressed fuel air mixture passes through the opening 140 formed within the wall of the piston 24 and into the inlet port 118 and hence into the combustion chamber 116. The inserting of the fuel air mixture through the inlet port into the combustion chamber 116 also facilitates movement of the exhaust gases outward through the exhaust port 114.

It is to be noted that this type of fuel inlet and exhaust arrangement could not be employed if the connecting rods 26 ever became canted with respect to the piston 24 during the reciprocating movement. Because the connecting rods 26 alway remain in a straight line, each connecting rod 26 can be sealed with respect to the plates 132 so that an enclosed chamber 120 can can result into which the fuel air mixture can be conducted.

What is claimed is:

1. An engine comprising:

a housing;

a pair of cylinders attached to said housing arranged in an oppositely facing in-line manner;

a piston movably mounted within each of said cylinders, each said piston connected to a connecting rod, each said connecting rod being rotatably mounted upon a crank pin of a crank shaft, said connecting rods having a rotational axis defined as a first axis, said first axis being displaced from the axis of said crank shaft;

a planet gear assembly attached to said crank shaft with the rotating axis of said planet gear assembly coinciding with said crank shaft axis, said planet gear assembly including at least one in number of planet gears, said planet gear assembly operatively connected with an internal ring gear assembly, said internal ring gear assembly including at least one in number of internal ring gears, the diameterof said planet gear being one-half the diameter of said internal ring gear; and a planetary crank carrier assembly located about said crank shaft, said planetary crank carrier assembly including at least one in number of planetary crank carriers, said crank shaft being rotatably mounted within said planetary crank carrier assembly, said planetary crank carrier assembly being rotatably mounted to said housing, said crank shaft being eccentrically located with respect to the rotating axis of said planetary crank carrier assembly, a said planetary crank carrier located between a said crank pin and a said internal ring gear, said planetary crank carrier assembly being operatively connected to an output gear assembly which is connected to an output shaft.

2. The engine as defined in claim 1 wherein:

said planet gear assembly comprises at least two in number of planet gears, said internal ring gear assembly comprises at least two in number of internal ring gears, a single said planet gear being operatively connected with a single said internal ring gear, a said internal ring gear and its repsective said planet gear being located on opposite sides of said crank pin and being equally displaced therefrom.

3. The engine as defined in claim 1 wherein: said connecting rods being mounted in an in-line relationship.

4. The engine as defined in claim 1 wherein:

said output gear assembly comprising two separate spaced apart output gears, each said output gears being located on opposite sides of said crank pin and being equally spaced therefrom.

5. The engine as defined in claim 4 wherein:

the rotating axis of said output shaft being parallel to the rotating axis of said crank shaft.

6. The engine as defined in claim 5 wherein:

said planetary crank carrier asssembly comprising two in number of planetary crank carrier, a said planetary crank carrier being located on opposite sides of said crank pin and being equally displaced therefrom, each said planetary crank carrier being connected to an external ring gear mounted upon the periphery of each said planetary crank carrier, each said external ring gears being operatively connected to said output gear assembly.

7. The engine as defined in claim 1 wherein:

said crank shaft extends exteriorly of said housing forming an exterior portion of said crank shaft, a counterweight being mounted on said exterior portion.

8. The engine as defined in claim 1 including:

a counterweight attached to said planetary crank carrier assembly.

9. The engine as defined in claim 6 wherein:

said planet gear assembly comprises at least two in number of planet gears, said internal ring gear assembly comprises at least two in number of internalring gears, a single said planet gear being operatively connected with a single said internal ring gear, a said internal ring gear and its respective said planet gear being located on opposite sides of said crank pin and being equally displaced therefrom.

10. The engine as defined in claim 9 wherein:

each said internal ring gear being inserted within a said planetary crank carrier with rotational movement permitted therebetween.

11. The engine as defined in claim 10 wherein:

said output gear assembly comprising two separate spaced apart output gears, each said output gears being located on opposite sides of said crank pin and being equally spaced therefrom.

* * * * *